US009498793B2

(12) United States Patent
Hong et al.

(10) Patent No.: US 9,498,793 B2
(45) Date of Patent: Nov. 22, 2016

(54) WET COATING METHOD

(71) Applicant: NATIONAL CHENG KUNG UNIVERSITY, Tainan (TW)

(72) Inventors: Chau-Nan Hong, Tainan (TW); Chun-Chia Yeh, Tainan (TW); Hsiang-En Hsu, Tainan (TW); Ke-Fong Li, Tainan (TW); Cyun-Jhe Yan, Tainan (TW); Chung-Sheng Chiang, Tainan (TW); Yu-Ling Cheng, Tainan (TW)

(73) Assignee: NATIONAL CHENG KUNG UNIVERSITY, Tainan (TW)

( * ) Notice: Subject to any disclaimer, the term of this patent is extended or adjusted under 35 U.S.C. 154(b) by 208 days.

(21) Appl. No.: 14/133,671

(22) Filed: Dec. 19, 2013

(65) Prior Publication Data

US 2015/0118408 A1 Apr. 30, 2015

(30) Foreign Application Priority Data

Oct. 28, 2013 (TW) ..... 102138921 A

(51) Int. Cl.

| | |
|---|---|
| ***B05D 3/14*** | (2006.01) |
| *B05D 1/00* | (2006.01) |
| *C23C 18/12* | (2006.01) |

(52) U.S. Cl.

CPC ..... *B05D 3/148* (2013.01); *B05D 3/142* (2013.01); *B05D 1/62* (2013.01); *B05D 3/147* (2013.01); *C23C 18/1216* (2013.01)

(58) Field of Classification Search

CPC ..... B05D 3/148; B05D 3/142; B05D 3/147
See application file for complete search history.

(56) References Cited

U.S. PATENT DOCUMENTS

2012/0223302 A1* 9/2012 Yukinobu ..... C09D 1/00 257/43

FOREIGN PATENT DOCUMENTS

TW 200710254 3/2007

* cited by examiner

*Primary Examiner* — Xiao Zhao
(74) *Attorney, Agent, or Firm* — CKC & Partners Co., Ltd.

(57) ABSTRACT

A wet coating method is described, which includes the following steps. A film coating is applied to at least one surface of a substrate using a wet process. A plasma-assisted filling treatment is performed on the film coating to crystallize the film coating into a film. The plasma-assisted filling treatment includes using a filling coating.

15 Claims, 6 Drawing Sheets

WET COATING METHOD

RELATED APPLICATIONS

This application claims priority to Taiwan Application Serial Number 102138921, filed Oct. 28, 2013, which is herein incorporated by reference.

BACKGROUND

Field of Invention

The present invention relates to a coating technique, and more particularly to a wet coating method.

Description of Related Art

As electronic devices are increasingly compact, volumes of various components of the electronic devices are greatly shrunk. In addition, due to popularization of portable electronic devices and availability of wearable electronic devices, surface coating apparatuses, which can provide coating treatments with high precision, are needed for satisfying developing requirements of the electronic devices.

However, flatness of films formed by using typical coating treatments for compact electronic components has not satisfied the requirements of the electronic devices, which continue to be scaled down. Specifically to optical films or transparent films, tolerant margin of error of these films is only of nanometer order. In addition, for a substrate with a lower fusion point or lower hardness, such as a plastic substrate, because the substrate cannot sustain high temperature, current film-coating techniques for compact electronic components can only use low temperature methods to treat a coating coated on a surface of the substrate for converting the property of the coating. Thus, choices of the coatings are limited and sometimes films with desirable functions cannot be successfully formed on the substrates.

SUMMARY

Therefore, one aspect of the present invention is to provide a wet coating method, in which a film coating is applied onto a substrate by using a wet process, and the film coating is crystallized to a film by using plasma energy, so that a defect density of the film is decreased, and the flatness of the film is enhanced.

Another aspect of the present invention is to provide a wet coating method, in which a plasma treatment for crystallizing a film coating into a film has a shallow heating depth without reaching a surface of a substrate, so that it can prevent the substrate from deforming due to the affect of the heat, and various substrates can be used.

Still another aspect of the present invention is to provide a wet coating method, which can form a film with high flatness, thus can be applied to fabricate a film, such as an optical film that needs high flatness.

According to the aforementioned objectives, the present invention provides a wet coating method, which includes the following steps. A film coating is applied to at least one surface of a substrate using a wet process. A plasma-assisted filling treatment is performed on the film coating to crystallize the film coating into a film, in which the plasma-assisted filling treatment comprises using a filling coating According to a preferred embodiment of the present invention, before the step of applying the film coating, the wet coating method further includes performing a plasma treatment on the at least one surface of the substrate to form a plurality of functional groups on the at least one surface.

According to another preferred embodiment of the present invention, the plasma treatment includes using an atmospheric pressure plasma.

According to still another preferred embodiment of the present invention, the plasma treatment includes using a working gas, and the working gas includes nitrogen ($N_2$), argon (Ar), helium (He), nitrogen and oxygen ($O_2$), argon and oxygen, or helium and oxygen.

According to further another preferred embodiment of the present invention, the wet process includes a slot die coating process, a dipping process, a spin coating process, a brush coating process, a spray coating process, an electrostatic coating process or an electrospinning coating process.

According to yet another preferred embodiment of the present invention, the step of applying the film coating includes using a twin-fluid high pressure airflow atomization nozzle, a high speed centrifugal spin coater, an electrostatic atomization disc coater, a sheet piezoelectric ceramics high speed vibration atomization nozzle, a high speed airflow impinging atomization ultrasonic nozzle, an ultrasonic atomization nozzle, an electrostatic spray gun, a spin coater, a brush, coater or a spray coater.

According to still further another preferred embodiment of the present invention, the plasma-assisted filling treatment includes using an atmospheric pressure plasma.

According to still further another preferred embodiment of the present invention, the film coating includes an inorganic coating, and the inorganic coating includes a silicon oxide collosol, an aluminum oxide collosol or a titanium oxide collosol.

According to still further another preferred embodiment of the present invention, when the inorganic coating is the silicon oxide collosol, the plasma-assisted filling treatment includes using a silicon plasma. When the inorganic coating is the aluminum oxide collosol, the plasma-assisted filling treatment includes using an aluminum plasma. When the inorganic coating is the titanium oxide collosol, the plasma-assisted filling treatment includes using a titanium plasma.

According to still further another preferred embodiment of the present invention, the film coating includes an organic coating, and the organic coating includes an acrylic coating or an epoxy resin-based coating.

According to still further another preferred embodiment of the present invention, the plasma-assisted filling treatment includes using an organic plasma, a solvent plasma, an oxygen plasma, a nitrogen plasma, an argon plasma, a fluorine-based plasma, a fluorine-containing ether-based plasma or a carbon dioxide plasma.

According to still further another preferred embodiment of the present invention, the film coating includes an anti-reflection coating, an anti-glare coating, an anti-fingerprint coating, a transparent conductive coating, an electrochromic coating, a heat insulation coating or a low emissivity glass coating.

According to still further another preferred embodiment of the present invention, the plasma-assisted filling treatment includes using an organic plasma, a solvent plasma, an oxygen plasma, a nitrogen plasma, an argon plasma, a fluorine-based plasma, a fluorine-containing ether-based plasma, a carbon dioxide plasma, an aluminum plasma, a silicon plasma or a titanium plasma.

According to still further another preferred embodiment of the present invention, the film coating includes an acrylic monomer compound coating, an epoxy base monomer compound coating or a polyurethane monomer compound coating.

According to still further another preferred embodiment of the present invention, the plasma-assisted filling treatment includes using an organic plasma, a solvent plasma, an oxygen plasma, a nitrogen plasma, an argon plasma, a fluorine-based plasma, a fluorine-containing ether-based plasma, a carbon dioxide plasma, an aluminum plasma, a silicon plasma or a titanium plasma.

According to still further another preferred embodiment of the present invention, a heating depth of the plasma-assisted filling treatment is from 0 to 30 μm.

BRIEF DESCRIPTION OF THE DRAWINGS

The foregoing aspects and many of the attendant advantages of this invention are more readily appreciated as the same become better understood by reference to the following detailed description, when taken in conjunction with the accompanying drawings, wherein.

DETAILED DESCRIPTION

Figure 1:
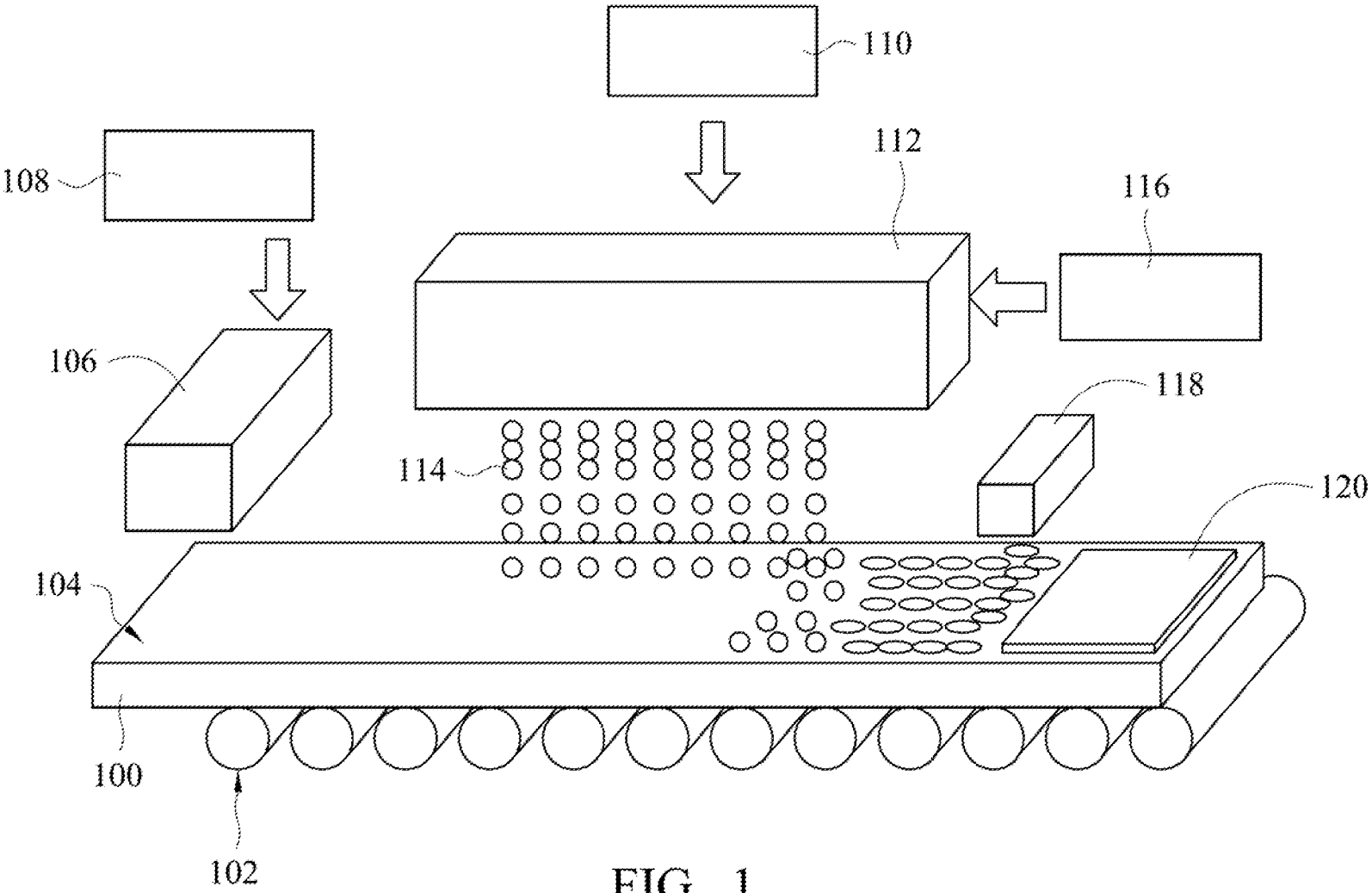
FIG. 1 is a schematic diagram showing a coating apparatus in accordance with an embodiment of the present invention.
Figure 2:
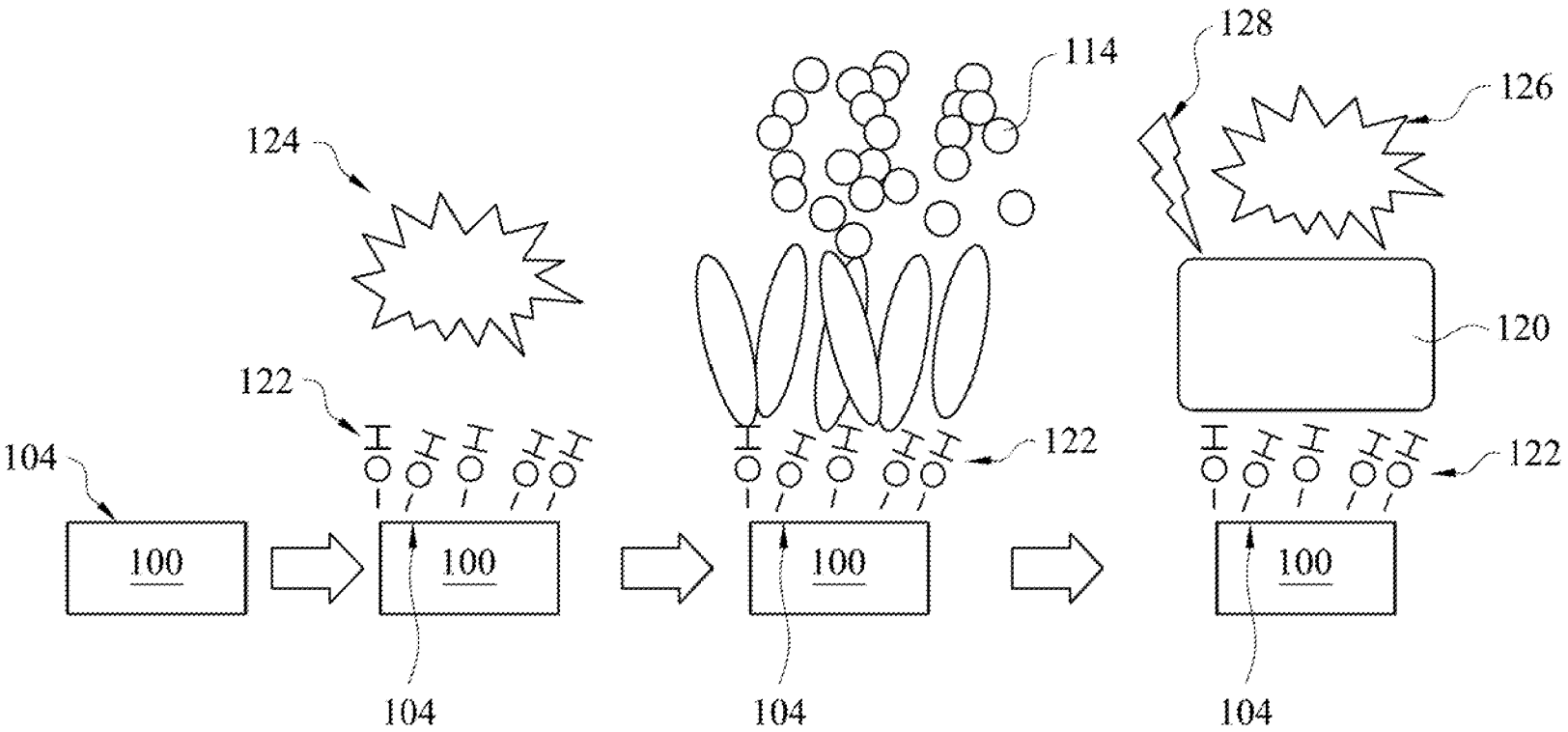
FIG. 2 is a schematic diagram showing a procedure of a coating method in accordance with an embodiment of the present invention.

Referring to FIG. 1 and FIG. 2 simultaneously. FIG. 1 and FIG. 2 are schematic diagrams respectively showing a coating apparatus and a procedure of a coating method in accordance with an embodiment of the present invention. In the present embodiment, a desirable film 120 can be coated on at least one surface 104 of a substrate 100 by using, for example, a coating apparatus shown in FIG. 1. The coating apparatus mainly includes a delivery device 102, a surface treatment device 106, a coating supplying device 110, a coating applying device 112 and a plasma-assisted filling device 118. The delivery device 102 can be used to carry and deliver the substrate 100 to be coated with a film. In some embodiments, the delivery device 102 includes a plurality of rollers to deliver the substrate 100 disposed thereon.

The surface treatment device 106 is disposed above a surface 104 of the substrate 100 to be coated with a film to perform a surface treatment on the surface 104, so as to form a plurality of functional groups on the surface 104. In some embodiments, the surface treatment device 106 is an atmospheric pressure plasma. The coating apparatus may further includes a power supply 108 for provide the surface treatment device 106 with power. In certain embodiments, a surface treatment procedure for the surface 104 of the substrate 100 is omitted according to the requirement of the coating process, so that the surface treatment device 106 is unnecessary.

The coating supplying device 110 stores a coating 114 used to form a film 120. The coating supplying device 110 communicates with the coating applying device 112 for providing the coating applying device 112 with the coating 114. The coating supplying device 110 may be equipped with a control unit for controlling the speed of supplying the coating 114 to the coating applying device 112. The coating applying device 112 is similarly disposed above the surface 104 of the substrate 100 to be coated with the film 120 and is located next to the surface treatment device 106. In some embodiments, the coating applying device 112 is a twin-fluid high pressure airflow atomization nozzle, a high speed centrifugal spin coater, an electrostatic atomization disc coater, a sheet piezoelectric ceramics high speed vibration atomization nozzle, a high speed airflow impinging atomization ultrasonic nozzle, an ultrasonic atomization nozzle, an electrostatic spray gun, a spin coater, a brush coater or a spray coater. In certain embodiments, the coating apparatus ray further includes a power supply 116 for provide the coating applying device 112 with power.

Figure 3:
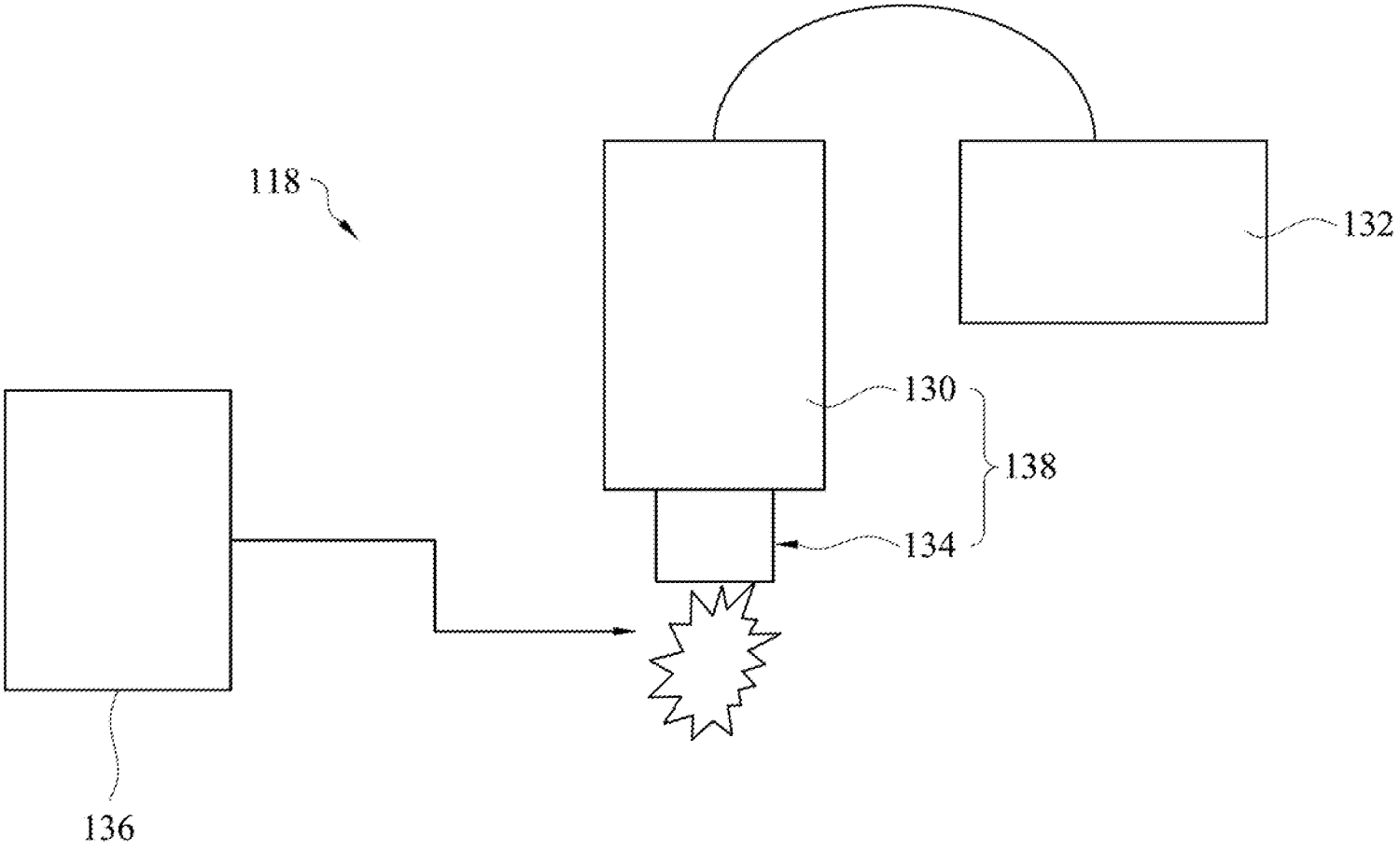
FIG. 3 is a schematic diagram showing a plasma-assisted filling device in accordance with are embodiment of the present invention.

The plasma-assisted filling device 118 is also disposed above the surface 104 of the substrate 100 to be coated with the film 120 and is located next to the coating applying device 112. In some embodiments, the plasma-assisted filling device 118 is an atmospheric pressure plasma device. Referring to FIG. 3 simultaneously, which is a schematic diagram showing a plasma-assisted filling device in accordance with an embodiment of the present invention. In some embodiments, the plasma-assisted filling device 118 mainly includes a plasma device 138, a power supply 132 and a filling coating supplying device 136. The plasma 138 mainly includes a case 130 and a plasma jet 134. The plasma jet 134 is disposed on one end of the case 130, and plasma generated by the plasma device 138 is jetted from the plasma jet 134. In some examples, the plasma device 138 is an atmospheric pressure plasma device. The power supply 132 is electrically connected to the plasma device 138 for provide the plasma device 138 with power. The power supply 132 may be an alternating current (AC) power supply, for example. The filling coating supplying device 136 contains a filling coating and can provide the plasma device 138 with the filling coating.

Referring to FIG. 1 and FIG. 2 again, in some exemplary embodiments, when the wet coating process is performed, according to the process requirement, a surface treatment is optionally performed on the surface 104 of the substrate 100 to be coated with the film 120 by using the surface treatment device 106 to form a plurality of functional groups 122 on the surface 104 so as to activate the surface 104. In the embodiment shown in FIG. 2, the functional groups 122 are hydroxyl groups (—OH). In certain embodiments, the functional groups 122 may be carboxyl groups (—COOH), carbonyl groups (—CO) or amino groups (—NH). In some exemplary examples, the surface treatment is a plasma treatment, and the surface treatment device 106 is a plasma device. A plasma 124 generated by the surface treatment device 106 is used to treat the surface 104 of the substrate 100. In addition, the plasma treatment is performed by using an atmospheric pressure plasma, for example. The plasma treatment includes using a working gas, and the working gas includes nitrogen, argon, helium, nitrogen and oxygen, argon and oxygen, or helium and oxygen, for example.

In the surface treatment step, the plasma has thermal energy, ultraviolet light energy and free radicals, so that after the surface treatment is performed, the concentration of the chemistry functional groups including —OH, —COOH, —CO and —NH on the surface 104 of the substrate 100 is greatly enhanced. Thus, the wetting and adhesive ability of the surface 104 is increased, so that a coating layer of the film 120 subsequently applied onto the surface 104 can be covered the surface 104 more flatly.

With the delivering of the delivery device 102, the surface 104 of the substrate 100 after being surface treated gets into the underneath of the coating applying device 112 next to the surface treatment device 106. The coating applying device 112 applies the film coating 114 supplied by the coating supplying device 110 onto the surface 104 of the substrate 100 by a wet process, for example. In some exemplary embodiments, the wet process includes a slot die coating process, a dipping process, a spin coating process, a brush coating process, a spray coating process, an electrostatic coating process or an electrospinning coating process. In addition, the step of applying the coating 114 of the film 120 through the wet process may be performed by using a twin-fluid high pressure airflow atomization nozzle, a high speed centrifugal spin coater, an electrostatic atomization disc coater, a sheet piezoelectric ceramics high speed vibration atomization nozzle, a high speed airflow impinging atomization ultrasonic nozzle, an ultrasonic atomization nozzle, an electrostatic spray gun, a spin coater, a brush coater or a spray coater.

As shown in FIG. 2, because the concentration of the chemistry functional groups on the surface 104 of the substrate 100 to be coated is increased, the coating 114 can be successfully and flatly adhered to the surface 104. Moreover, the coating 114 may further react with the functional groups on the surface 104 of the substrate 100, so that the coating 114 can be firmly adhered to the surface 104 of the substrate 100.

In some exemplary embodiments, the coating 114 of the film 120 is a collosol coating, such as a silicon oxide collosol, an aluminum oxide collosol, a titanium oxide collosol, an acrylic coating and an epoxy resin-based coating. The silicon oxide collosol, the aluminum oxide collosol and the titanium oxide collosol are inorganic coatings, and the acrylic coating and the epoxy resin-based coating are organic coatings. In certain exemplary embodiments, the coating 114 of the film 120 is a functional film coating, such as an anti-reflection coating, an anti-glare coating, an anti-fingerprint coating, a transparent conductive coating, an electrochromic coating, a heat insulation coating or a low emissivity glass coating. The electrochromic coating may include tungsten trioxide ($WO_3$) or vanadium pentoxide ($V_2O_5$). In various exemplary embodiments, the coating 114 of the film 120 is a macromolecule monomer compound coating, such as an acrylic monomer compound coating, an epoxy base monomer compound coating or a polyurethane monomer compound coating.

After the coating 114 is applied, with the delivering of the delivery device 102, the surface 104 of the substrate 100 coated with the coating 114 gets into the underneath of the plasma-assisted filling device 118 next to the coating applying device 112. The coating 114 on the surface 104 of the substrate 100 is supplied with plasma active substances 126, ultraviolet light 128 and thermal energy, by using the plasma-assisted filling device 118 and introducing the plasma, such as an atmospheric pressure gas plasma, a free radical active substance plasma or a chemical plasma generated while the coating is filled. With the plasma active substances 126, the ultraviolet light 128 and the thermal energy, crystals of the coating 114 are filled to anneal and crystallize the coating 114, so as to form the film 120 on the surface 104 of the substrate 100, as shown in FIG. 1 and FIG. 2. In some exemplary embodiments, a heating depth of the plasma-assisted filling treatment is form 0 to 30 μm. Because the heating depth of the plasma-assisted filling treatment of the present embodiment is shallower to only heat the coating 114 without heating the substrate 100, the substrate 100 can be prevented from being damaged due to the thermal energy of the plasma. Thus, the present embodiment can be applied on the substrate 100 composed of plastics or materials, which need low temperature treatments.

In the present invention, the filling coating used in the plasma-assisted filling treatment is preferably adapted to the coating 114 coated on the surface 104 of the substrate 100 to form appropriate plasma active substances, so as to perform different crystallization mechanisms for different coatings 114. For example, the irradiation of the ultraviolet light 128 of the plasma hardens the coating 114, the free radicals of the plasma active substances 126 are actuated to harden the coating 114, a crystal form of the coating 114 is changed, and crystallinity of the coating 114 is improved.

Figure 4A:
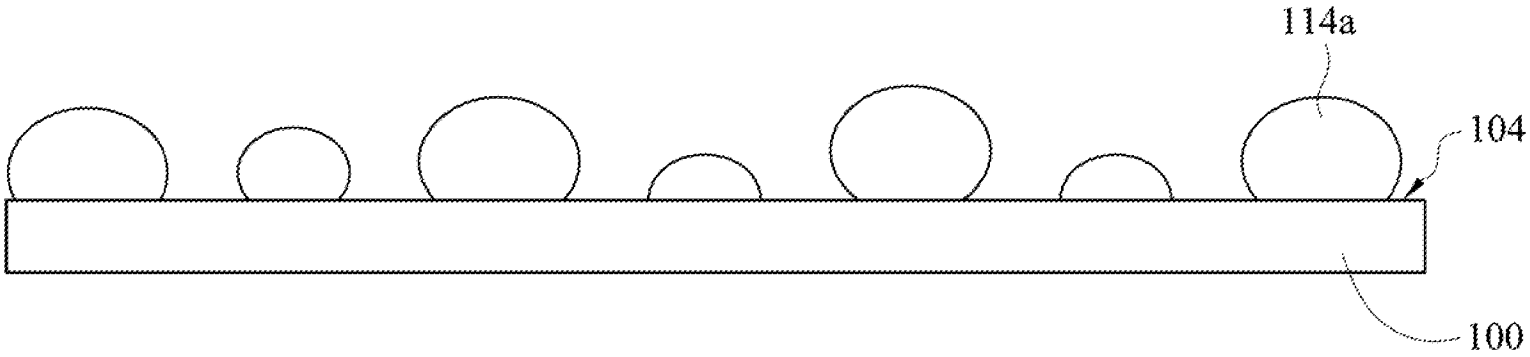
FIG. 4A and FIG. 4B are schematic diagrams of intermediate stages showing a plasma-assisted filling treatment in accordance with an embodiment of the present invention.
Figure 4B:
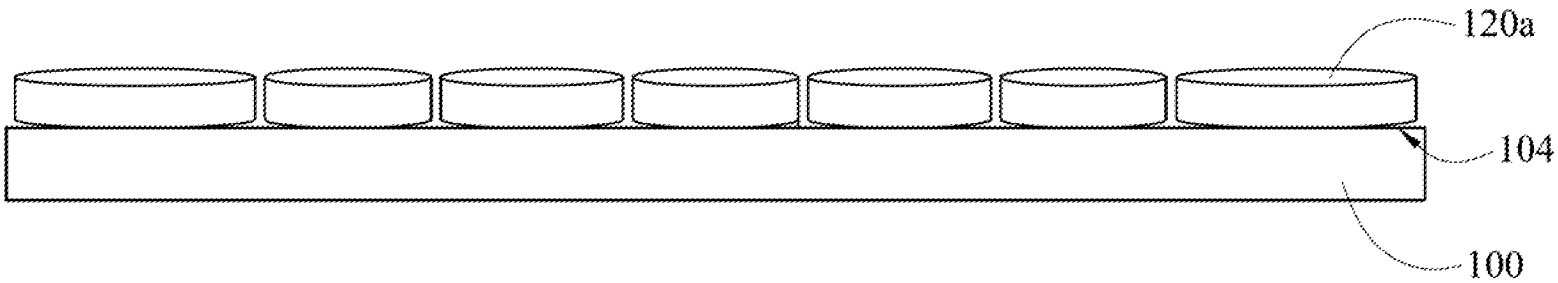

Refer to FIG. 4A and FIG. 4B. FIG. 4A and FIG. 4B are schematic diagrams of intermediate stages showing a plasma-assisted filling treatment in accordance with an embodiment of the present invention. In the embodiment, a coating 114*a* composed of an inorganic collosol is applied onto a surface 104 of the substrate 100, as shown in FIG. 4A. Then, as shown in FIG. 4B, the treated coating 114*a* is annealed and crystallized to form a flatter inorganic film 120*a* by using an annealing treatment using the thermal energy of the plasma and a filling effect generated by the plasma active substances 126 of the plasma, which is provided by the plasma-assisted filling treatment.

For example, when the coating 114*a* is a silicon oxide collosol, the plasma-assisted filling treatment may include using a silicon plasma, such as a silicone plasma including a tetraethoxysilane (TEOS) plasma or a hexamethyldisiloxane (HMDSO) plasma, and a halosilane plasma. When the coating 114*a* is an aluminum oxide collosol, the plasma-assisted filling treatment may include using an aluminum plasma such as an aluminoxane plasma including a methylaluminoxane (MAO) plasma or an isobutylaluminoxane (IBAO) plasma, and an aluminum alkyl halide plasma. When the coating 114*a* is a titanium oxide collosol, the plasma-assisted filling treatment may include using a titanoxane plasma including a titanium alkoxide plasma, such as a titanium isopropoxide (TTIP) plasma, and a titanium alkyl halide plasma.

Figure 5A:
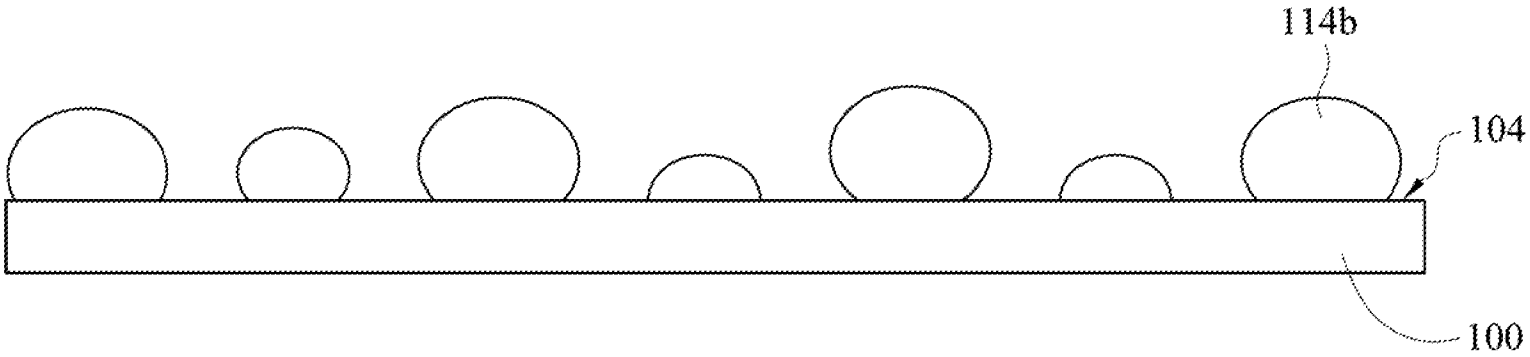
FIG. 5A and FIG. 5B are schematic diagrams of intermediate stages showing a plasma-assisted filling treatment in accordance with another embodiment of the present invention.
Figure 5B:
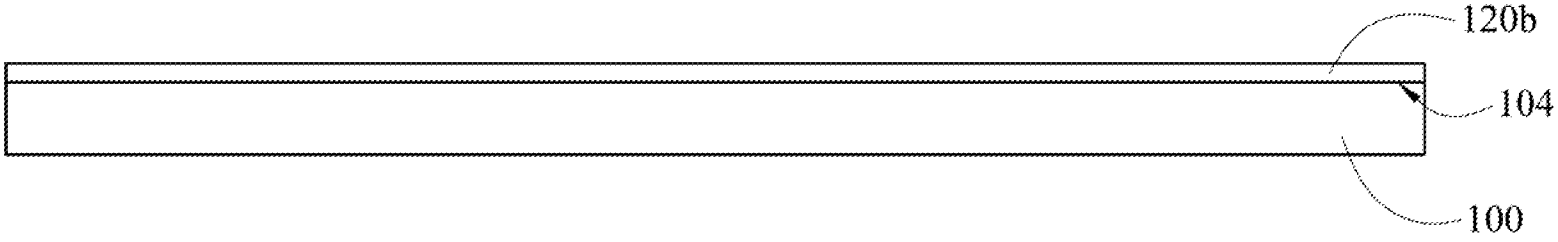

Refer to FIG. 5A and FIG. 5B. FIG. 5A and FIG. 5B are schematic diagrams of intermediate stages showing a plasma-assisted filling treatment in accordance with another embodiment of the present invention. In the embodiment, an organic coating 114*b* is applied onto a surface 104 of the substrate 100 as shown in FIG. 5A. Next, as shown in FIG. 5B, the treated coating 114*b* is crystallized to form a flatter and uniform organic film 120*b* by using the actuation of the ultraviolet light 128, the actuation of the free radicals, and a filling effect generated by the plasma active substances 126 of the plasma, which is provided by the plasma-assisted filling treatment.

For example, the coating 114*b* may be an acrylic coating or an epoxy resin-based coating. In addition, the plasma-assisted filling treatment may include using an oxygen plasma, a nitrogen plasma, an argon plasma, a fluorine-based plasma, a fluorine-containing ether-based plasma or a carbon dioxide plasma; an organic plasma, such as an alkane-based plasma, an alkyne-based plasma, an alkene-based plasma and an acrylate-based plasma; or a solvent plasma, such as an alcohol-based plasma, a water plasma, a formic acid plasma and an acetic acid plasma.

Figure 6A:
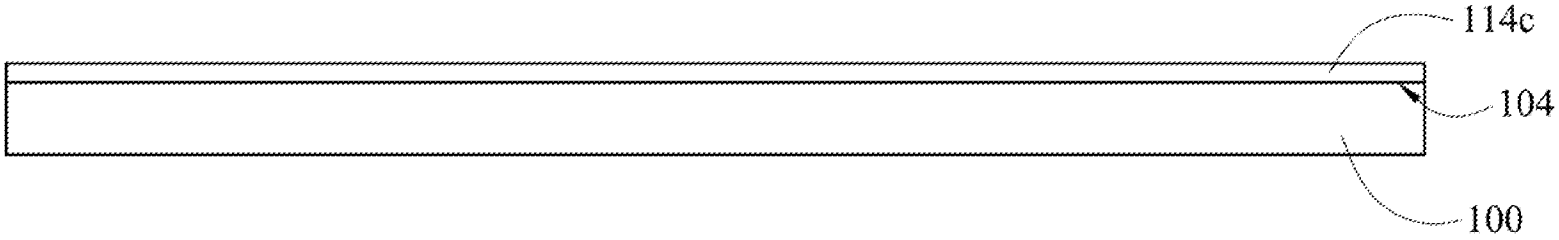
FIG. 6A and FIG. 6B are schematic diagrams of intermediate stages showing a plasma-assisted filling treatment in accordance with still another embodiment of the present invention.
Figure 6B:
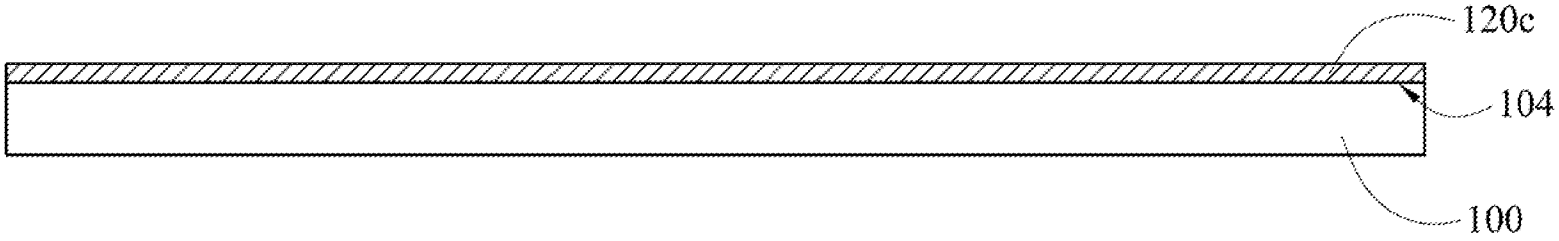

Refer to FIG. 6A and FIG. 6B. FIG. 6A and FIG. 6B are schematic diagrams of intermediate stages showing a plasma-assisted filling treatment in accordance with still another embodiment of the present invention. In the embodiment, a functional coating 114*c* is applied onto a surface 104 of the substrate 100, as shown in FIG. 6A. Next, as shown in FIG. 6B, the treated coating 114*c* is crystallized into a functional film 120*c* by using the modification of the plasma and a filling effect generated by the plasma active substances 126 of the plasma, which is provided by the plasma-assisted filling treatment.

For example, the coating 114*c* may be an anti-reflection coating, an anti-glare coating, an anti-fingerprint coating, a transparent conductive coating, an electrochromic coating, a heat insulation coating or a low emissivity glass coating. The electrochromic coating may include tungsten trioxide or vanadium pentoxide. In addition, the plasma-assisted filling treatment includes using an oxygen plasma, a nitrogen plasma, an argon plasma, a fluorine-based plasma, a fluorine-containing ether-based plasma or a carbon dioxide plasma; an aluminum plasma, a silicon plasma or a titanium plasma; an organic plasma, such as an alkane-based plasma, an alkyne-based plasma, an alkene-based plasma and an acrylate-based plasma; or a solvent plasma, such as an alcohol-based plasma, a water plasma, a formic acid plasma and an acetic acid plasma.

In addition, when the coating 114*c* includes an acrylic monomer compound coating, an epoxy base monomer compound coating or a polyurethane monomer compound coating, the plasma-assisted filling treatment may include using an oxygen plasma, a nitrogen plasma, an argon plasma, a fluorine-based plasma, a fluorine-containing ether-based plasma or a carbon dioxide plasma; or an aluminum plasma, a silicon plasma or a titanium plasma; an organic plasma, such as an alkane-based plasma, an alkyne-based plasma, an alkene-based plasma and an acrylate-based plasma; or a solvent plasma, such as an alcohol-based plasma, a water plasma, a formic acid plasma and an acetic acid plasma.

According to the aforementioned embodiments, one advantage of the present invention is that in a wet coating method of the present invention, a film coating is applied onto a substrate by using a wet process, and the film coating is crystallized to a film by using plasma energy, so that a defect density of the film is decreased, and the flatness of the film is enhanced.

According to the aforementioned embodiments, another advantage of the present invention is that in a wet coating method of the present invention, a plasma treatment for crystallizing a film coating into a film has a shallow heating depth without reaching a surface of a substrate, so that it can prevent the substrate from deforming due to the affect of the heat, and various substrates can be used.

According to the aforementioned embodiments, still another advantage of the present invention is that with the application of a wet coating method of the present invention can form a film with high flatness, thus can be applied to fabricate a film, such as an optical film that needs high flatness.

As is understood by a person skilled in the art, the foregoing preferred embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A wet coating method, the wet coating method comprising:

performing a plasma treatment on at least one surface of a substrate to form a plurality of functional groups on the at least one surface;

applying a film coating to the at least one surface of the substrate using a wet process; and performing a plasma-assisted treatment on the film coating to fill crystals of the film coating to crystallize the film coating into a film.

2. The wet coating method according to claim 1, wherein the plasma treatment comprises using an atmospheric pressure plasma.

3. The wet coating method according to claim 1, wherein the plasma treatment comprises using a working gas, and the working gas comprises nitrogen, argon, helium, nitrogen and oxygen, argon and oxygen, or helium and oxygen.

4. The wet coating method according to claim 1, wherein the wet process comprises a slot die coating process, a dipping process, a spin coating process, a brush coating process, a spray coating process, an electrostatic coating process or an electrospinning coating process.

5. The wet coating method according to claim 1, wherein the step of applying the film coating comprises using a twin-fluid high pressure airflow atomization nozzle, a high speed centrifugal spin coater, an electrostatic atomization disc coater, a sheet piezoelectric ceramics high speed vibration atomization nozzle, a high speed airflow impinging atomization ultrasonic nozzle, an ultrasonic atomization nozzle, an electrostatic spray gun, a spin coater, a brush coater or a spray coater.

6. The wet coating method according to claim 1, wherein the plasma-assisted treatment comprises using an atmospheric pressure plasma.

7. The wet coating method according to claim 1, wherein the film coating comprises an inorganic coating, and the inorganic coating comprises a silicon oxide collosol, an aluminum oxide collosol or a titanium oxide collosol.

8. The wet coating method according to claim 7, wherein when the inorganic coating is the silicon oxide collosol, the plasma-assisted treatment comprises using a silicon plasma;

when the inorganic coating is the aluminum oxide collosol, the plasma-assisted treatment comprises using an aluminum plasma; and when the inorganic coating is the titanium oxide collosol, the plasma-assisted treatment comprises using a titanium plasma.

9. The wet coating method according to claim 1, wherein the film coating comprises an organic coating, and the organic coating comprises an acrylic coating or an epoxy resin-based coating.

10. The wet coating method according to claim 9, wherein the plasma-assisted treatment comprises using an organic plasma, a solvent plasma, an oxygen plasma, a nitrogen plasma, an argon plasma, a fluorine-based plasma, a fluorine-containing ether-based plasma or a carbon dioxide plasma.

11. The wet coating method according to claim 1, wherein the film coating comprises an anti-reflection coating, an anti-glare coating, an anti-fingerprint coating, a transparent conductive coating, an electrochromic coating, a heat insulation coating or a low emissivity glass coating.

12. The wet coating method according to claim 11, wherein the plasma-assisted treatment comprises using an organic plasma, a solvent plasma, an oxygen plasma, a nitrogen plasma, an argon plasma, a fluorine-based plasma, a fluorine-containing ether-based plasma, a carbon dioxide plasma, an aluminum plasma, a silicon plasma or a titanium plasma.

13. The wet coating method according to claim 1, wherein the film coating comprises an acrylic monomer compound coating, an epoxy base monomer compound coating or a polyurethane monomer compound coating.

14. The wet coating method according to claim 13, wherein the plasma-assisted treatment comprises using an organic plasma, a solvent plasma, an oxygen plasma, a nitrogen plasma, an argon plasma, a fluorine-based plasma, a fluorine-containing ether-based plasma, a carbon dioxide plasma, an aluminum plasma, a silicon plasma or a titanium plasma.

15. The wet coating method according to claim 1, wherein a heating depth of the plasma-assisted treatment is from 0 to 30 μm.

* * * * *